US005782703A

United States Patent [19]

Yamagishi et al.

[11] Patent Number: 5,782,703

[45] Date of Patent: Jul. 21, 1998

[54] PRACTICE GOLF BALL

[75] Inventors: Hisashi Yamagishi; Jun Shindo; Hiroto Sasaki, all of Chichibu, Japan

[73] Assignee: Bridgestone Sports Co., Ltd., Tokyo, Japan

[21] Appl. No.: 841,678

[22] Filed: Apr. 30, 1997

[30] Foreign Application Priority Data

May 1, 1996 [JP] Japan ..... 8-134248

[51] Int. Cl.[6] ..... A63B 37/14; A63B 69/36

[52] U.S. Cl. ..... 473/280; 473/384; 473/377; 273/DIG. 20

[58] Field of Search ..... 473/383, 384, 473/280, 377, 351; 273/DIG. 20

[56] References Cited

U.S. PATENT DOCUMENTS 5,601,503 2/1997 Yamagishi et al. ..... 473/351 X 5,702,312 12/1997 Horiuchi et al. ..... 473/384 X

*Primary Examiner*—George J. Marlo

*Attorney, Agent, or Firm*—Sughrue, Mion, Zinn, Macpeak & Seas, PLLC

[57] ABSTRACT

A practice golf ball having a multiplicity of dimples formed in its surface has a weight of 46.5–49.0 grams and undergoes a distortion of 2.5–4.0 mm under a constant load of 100 kg. Those dimples having a diameter/depth (Dm/Dp) ratio between 10/1 and 15/1 occupy at least 80% of the total number of dimples. The ball offers a good feel upon shots, follows a low trajectory without substantial shortage of a flight distance, and is thus suited for use in urban golf practice pits of limited space.

4 Claims, 3 Drawing Sheets

PRACTICE GOLF BALL

BACKGROUND OF THE INVENTION

1. Field of the Invention

This invention relates to a practice golf ball which will follow a low trajectory without detracting from flight performance and offers a good feel.

2. Prior Art

In Japanese cities, there are many urban golf practice pits which are constructed by surrounding a limited area with a net. Practice golf balls are used in the practice pits. If practice golf balls tend to follow a high trajectory, they will fly over the net and fall beyond the pit with the danger that they will damage something outside the pit. Practice golf balls which will follow a low trajectory so that the balls may not fly over the net are desired.

From this standpoint, JP-A 117969/1992 proposes a practice golf ball having a weight of 43 to 48 grams, a diameter of 1.65 to 1.71 inches, a dimple number of 300 to 550, and an overall dimple volume of 400 to 600 $mm^3$. This ball still follows a relatively high trajectory.

Although practice golf balls are used for practice, they are required not only to follow a low trajectory, but also to travel a satisfactory distance and present a good feel. Even the practice ball should give a pleasant feel on actual shots. Conventional practice golf balls have not fully taken such factors into account.

SUMMARY OF THE INVENTION

An object of the present invention is to provide a practice golf ball which will follow a low trajectory without detracting from flight performance and offers a good feel.

While competition golf balls must satisfy the standards in the Rules of Golf which prescribes a weight of not greater than 45.92 grams, practice golf balls need not necessarily satisfy the standards. Focusing on the ball weight, we first attempted to lower the trajectory of a golf ball in flight.

By increasing the weight of a golf ball to 46.5 to 49.0 grams beyond the limit of the Rules of Golf, we attempted to increase the gravity effect on the ball in flight to thereby prevent the ball from rising high, that is, to lower the trajectory. However, the gravity effect as such was insufficient to lower the trajectory and could reduce the flight distance. Through a further study, we attempted to adjust the aerodynamics of a golf ball by modifying dimples with respect to the depth and the diameter/depth ratio of dimples. We have found that the trajectory can be lowered at a little sacrifice of flight distance when dimples are made fully deep and the majority of dimples have a specific diameter/depth ratio, more specifically at least 80% of the entire dimples have a diameter/depth ratio between 10/1 and 15/1. Better results are obtained when these dimples have a depth of 0.20 to 0.35 mm.

Simply when the ball weight is increased as mentioned above, the impact force the player receives upon shots becomes greater than balls of the normal weight, failing to reproduce the usual hitting feel. Then the feel or skill the player has gained from practice is not helpful for the player to play on the course. When the ball is formed to undergo a distortion of 2.5 to 4.0 mm under a load of 100 kg, the ball presents a good feel comparable to that of ordinary competition balls. The present invention is predicated on these findings.

According to the invention, there is provided a practice golf ball having a multiplicity of dimples formed in its surface. The ball has a weight of 46.5 to 49.0 grams and undergoes a distortion of 2.5 to 4.0 mm under a constant load of 100 kg. Those dimples having a Dm/Dp ratio between 10/1 and 15/1 occupy at least 80% of the total number of dimples wherein an individual dimple has a diameter Dm and a depth Dp.

BRIEF DESCRIPTION OF THE DRAWINGS

These and further features of the present invention will be apparent with reference to the following description and drawings, wherein.

DETAILED DESCRIPTION OF THE INVENTION

Figure 1:
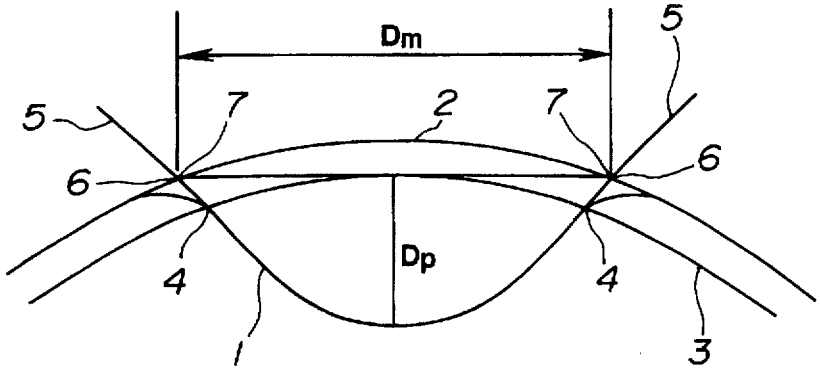
FIG. 1 is a schematic cross-sectional view of a dimple in the ball surface showing a maximum diameter Dm and a maximum depth Dp.

The practice golf ball of the present invention may be either a one-piece golf ball or a two-piece golf ball having a solid core enclosed with a cover. According to the invention, the ball has a weight of 46.5 to 49.0 grams, especially 47.0 to 48.8 grams. With a weight of more than 49.0 grams, the flight distance is reduced due to a greater gravity effect and the hitting feel is exacerbated due to a greater impact force upon shots. A weight of less than 46.5 grams provides an insufficient gravity effect to lower the trajectory, allowing the ball to follow a high trajectory.

The diameter of the ball is not particularly limited and may be approximately equal to that of conventional practice golf balls, for example 42.3 to 43.0 mm, preferably 42.5 to 42.8 mm.

The ball undergoes a distortion of at least 2.5 mm, preferably at least 2.7 mm, more preferably at least 2.8 mm under a constant load of 100 kg. A ball with a distortion of less than 2.5 mm provides a greater impact force upon shots and hence, a less pleasant feel. The upper limit of distortion is 4.0 mm, preferably 3.8 mm. A ball with a distortion of more than 4.0 mm provides an inferior separation of the ball from a club upon shots and hence, a less pleasant feel.

The practice golf ball of the present invention has a multiplicity of dimples in its surface. Provided that an individual dimple has a diameter Dm and a depth Dp, the invention requires that those dimples having a Dm/Dp ratio between 10/1 and 15/1, preferably between 11/1 and 14.5/1 occupy at least 80%, preferably at least 82% of the total number of dimples. This dimple adjustment, combined with the above-mentioned gravity effect, is effective for minimizing the reduction of flight distance and providing a low trajectory. If those dimples having a Dm/Dp ratio of less than 10/1 occupy at least 80% of the total number of dimples, that is, if most dimples have a greater depth relative to their diameter, then the ball will fly little high and follow a too low trajectory, resulting in a short flight distance. Due to a greater dimple depth, a deficient mark can be printed on a ball surface during ball manufacture. If those dimples having a Dm/Dp ratio of more than 15/1 occupy at least 80% of the total number of dimples, that is, if most dimples have a less depth relative to their diameter, then the ball will loft sharply and follow a high trajectory.

It is preferred from the standpoints of flight performance, trajectory and marking during manufacture that the dimples have a depth Dp of 0.2 to 0.35 mm, more preferably 0.22 to 0.33 mm. With a dimple depth Dp of less than 0.2 mm, the ball would loft sharply and follow a high trajectory. With a dimple depth Dp of more than 0.35 mm, the ball would follow a low trajectory and cover a short distance and proper marking would be difficult.

The overall number, shape and type of dimples formed on the golf ball of the invention are not critical. Preferably the ball has 300 to 460 dimples, more preferably 340 to 440 dimples in total. It is advantageous for flight distance that two or more types, especially two to four types of dimples which are different in diameter and depth are formed. The arrangement of dimples may be the same as in usual golf balls.

In a further preferred embodiment, provided that each dimple has a circular edge, the dimples satisfy $0.40 \leqq V_0 \leqq 0.65$ wherein $V_0$ is the volume of the dimple space below a circular plane circumscribed by the dimple edge, divided by the volume of a cylinder whose bottom is the circular plane and whose height is the maximum depth of the dimple from the bottom. With $V_0 > 0.65$, the ball would loft sharply and stall, traveling a short distance. With $V_0 < 0.40$, the trajectory would become rather declining.

Figure 2:
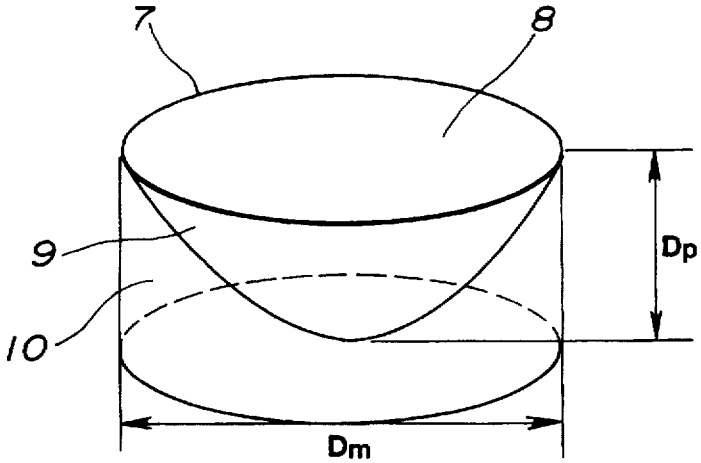
FIGS. 2 and 3 are schematic views illustrating how to calculate a dimple factor $V_O$.
Figure 3:
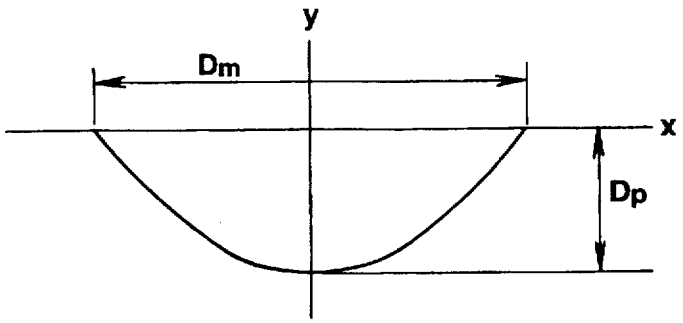
Figure 4:
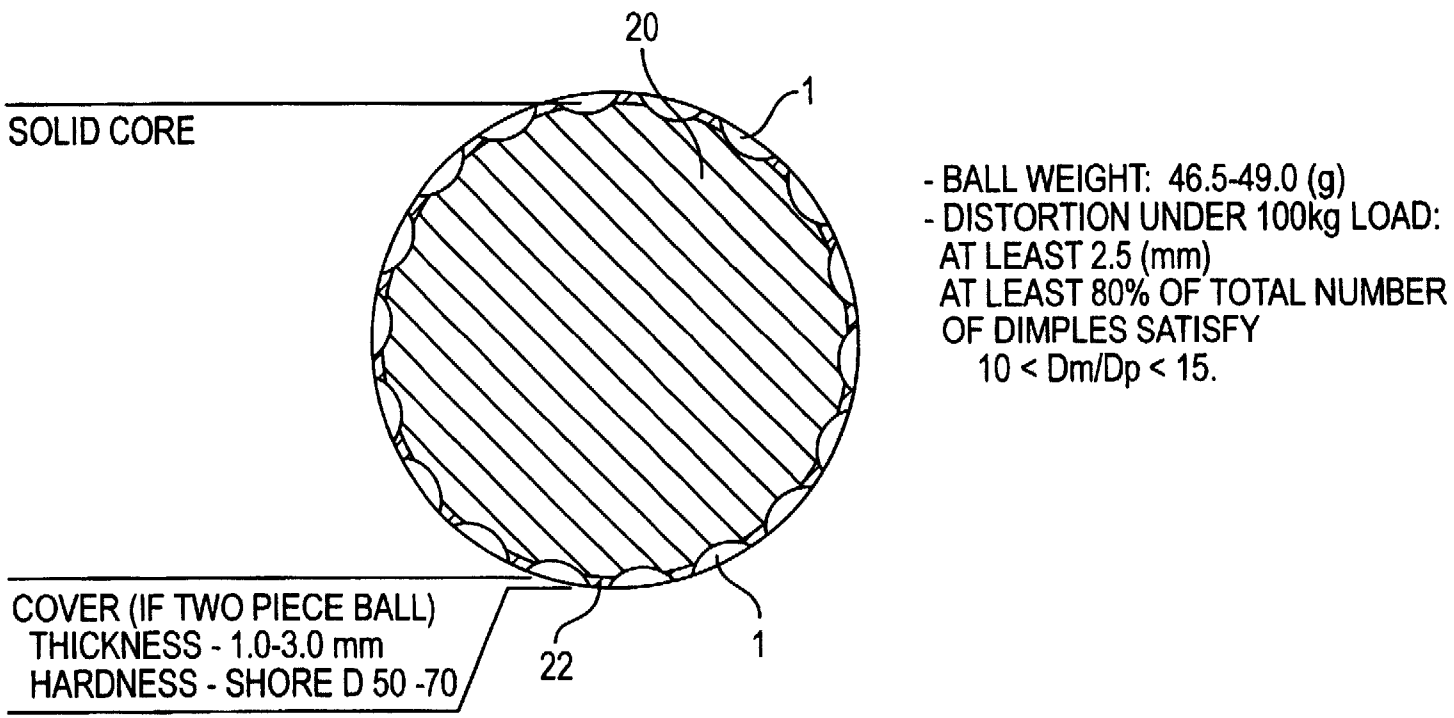
FIG. 4 illustrates a practice golf ball of the present invention.

Referring to FIGS. 1 to 3, the shape of dimples is described in further detail. For simplicity sake, it is now assumed that the shape of a dimple projected on a plane is circular. One dimple in a ball surface is shown in the schematic cross-sectional view of FIG. 1. In conjunction with the dimple 1, there are drawn a phantom sphere 2 having the ball diameter and another phantom sphere 3 having a diameter smaller by 0.16 mm than the ball diameter. The other sphere 3 intersects with the dimple 1 at a point 4. A tangent 5 at intersection 4 intersects with the phantom sphere 2 at a point 6. A series of intersections 6 define a dimple edge 7. The dimple edge 7 is so defined for the reason that otherwise, the exact position of the dimple edge cannot be determined because the actual edge of the dimple 1 is rounded. The dimple diameter Dm is the diameter of a circular plane 8 circumscribed by the dimple edge 7. The dimple depth Dp is the length from the center of the dimple diameter Dm to the bottom of the dimple.

The above-mentioned ratio $V_0$ is determined as follows. The dimple space 9 located below the circular plane 8 has a volume Vp as shown in FIG. 2. A cylinder 10 whose bottom is the circular plane 8 and whose height is the maximum depth Dp of the dimple from the bottom or circular plane 8 has a volume Vq. As shown in FIG. 3, the volume Vp of the dimple space 9 and the volume Vq of the cylinder 10 are calculated according to the following equations. The dimple space volume Vp is divided by the cylinder volume Vq to give a ratio $V_0$.

$$Vp = \int_0^{\frac{Dm}{2}} 2\pi xy dx$$

$$Vq = \frac{\pi Dm^2 Dp}{4}$$

$$V_0 = \frac{Vp}{Vq}$$

It is noted that an equivalent diameter is used in the event that the shape of a dimple projected on a plane is not circular. That is, the maximum diameter or length of a dimple projected on a plane is determined, and the plane projected shape of the dimple is assumed to be a circle having a diameter equal to this maximum diameter or length. The maximum depth Dp is the distance from the plane to the bottom of the dimple. Based on this assumption, $V_0$ is calculated as above.

As previously mentioned, the practice golf ball of the present invention may be either a one-piece golf ball or a two-piece golf ball although other structures are acceptable. The ball may be prepared from well-known stock materials by conventional methods. In the case of a two-piece golf ball, it is recommended from the standpoints of durability and hitting feel that the cover has a Shore D hardness of 50 to 70 and a thickness of 1.0 to 3.0 mm.

There has been described a practice golf ball which offers a good feel upon shots, follows a low trajectory and provides minimized reduction of flight distance. The ball is best suited for use in urban golf practice pits of limited space.

EXAMPLE

Examples of the present invention are given below by way of illustration and not by way of limitation.

Examples 1–3 & Comparative Examples 1–2

One-piece golf balls (Example 1 and Comparative Example 1) and solid cores (Examples 2, 3 and Comparative Example 2) were prepared by kneading a rubber compound of the composition shown in Table 1 in a roll mill and heat compression molding the compound at 170° C. for 25 minutes for the one-piece golf balls and at 155° C. for 15 minutes for the solid cores of two-piece golf balls. In Examples 2, 3 and Comparative Example 2, the solid cores were enclosed with a cover to form two-piece golf balls. The cover stock used was a 50/50 mixture of ionomer resins, Himilan 1706 and Himilan 1605 by Mitsui-duPont Polychemical K.K. In either case, the balls were provided with dimples as shown in Tables 2 and 3.

A mark was printed on the golf balls. Using 10 samples for each of Examples, the balls were examined for marking, trajectory, maximum height, maximum height distance, and hitting feel by the tests described below. The results are shown in Table 3.

Marking deficiency

The mark printed on the ball was visually inspected for any deficiency. A percent marking deficiency was calculated.

Trajectory

Using a swing robot (True Temper Co.), the ball was hit at a head speed of 45 m/sec. with a club having a loft angle of 11°. By taking photographs of the ball in flight, the trajectory that the ball followed was examined. The maximum height was determined therefrom. The distance at which the ball reached the maximum height was also determined.

Hitting feel

In an actual hitting test, the ball was rated "soft," "medium" or somewhat "hard."

TABLE 1

| Core or ball composition (pbw) | E1 | E2 | E3 | CE1 | CE2 |
|---|---|---|---|---|---|
| Cis-1,4-polybutadiene | 100 | 100 | 100 | 100 | 100 |
| Zinc acrylate | 0 | 17 | 16 | 0 | 0 |
| Methacrylic acid | 20 | 0 | 0 | 23.5 | 20 |
| Zinc oxide | 28 | 37 | 40 | 21 | 28 |
| Dicumyl peroxide | 1 | 1 | 1 | 1 | 1 |

TABLE 2

| Dimple type | | | | | |
|---|---|---|---|---|---|
| Type | Dm (mm) | Dp (mm) | Dm/Dp | $V_0$ | Number |
| I | 4.000 | 0.290 | 13.8 | 0.43 | 140 |
| | 3.800 | 0.275 | 13.8 | 0.43 | 120 |
| II | 4.000 | 0.250 | 16.0 | 0.47 | 72 |
| | 3.600 | 0.250 | 14.4 | 0.47 | 144 |
| | 3.300 | 0.250 | 13.2 | 0.47 | 216 |
| III | 3.600 | 0.360 | 10.0 | 0.45 | 336 |
| IV | 3.600 | 0.230 | 15.7 | 0.43 | 336 |

TABLE 3

| | E1 | E2 | E3 | CE1 | CE2 |
|---|---|---|---|---|---|
| Ball weight (g) | 47.00 | 47.50 | 48.50 | 45.20 | 47.00 |
| Ball diameter (mm) | 42.70 | 42.70 | 42.70 | 42.67 | 42.70 |
| Ball hardness* (mm) | 2.80 | 3.30 | 3.50 | 2.40 | 2.80 |
| Dimple type | I | I | II | III | IV |
| Structure | 1-piece | 2-piece | 2-piece | 1-piece | 1-piece |
| Marking deficiency | low | low | low | high | low |
| Maximum height (m) | 21 | 21 | 20 | 19 | 27 |
| Max. height distance (m) | 135 | 134 | 136 | 133 | 139 |

TABLE 3-continued

| | E1 | E2 | E3 | CE1 | CE2 |
|---|---|---|---|---|---|
| Trajectory | normal | normal | normal | declining | high |
| Hitting feel | medium | soft | soft | hard | medium |

*a distortion (mm) of the golf ball under a constant load of 100 kg

As is evident from Table 3, golf balls within the scope of the invention offer a good feel, reach a relatively low maximum height and follow a low trajectory without substantial shortage of a flight distance.

Japanese Patent Application No. 134248/1996 is incorporated herein by reference.

Although some preferred embodiments have been described, many modifications and variations may be made thereto in the light of the above teachings. It is therefore to be understood that within the scope of the appended claims, the invention may be practiced otherwise than as specifically described.

We claim:

1. A practice golf ball having a multiplicity of dimples formed in its surface, wherein said ball has a weight of 46.5 to 49.0 grams and undergoes a distortion of 2.5 to 4.0 mm under a constant load of 100 kg, and those dimples having a Dm/Dp ratio between 10/1 and 15/1 occupy at least 80% of the total number of dimples wherein an individual dimple has a diameter Dm and a depth Dp.

2. The practice golf ball of claim 1 wherein said dimples having a Dm/Dp ratio between 10/1 and 15/1 have a depth Dp of 0.20 to 0.35 mm.

3. The practice golf ball of claim 1 which is a one-piece golf ball.

4. The practice golf ball of claim 1 which is a two-piece golf ball having a core enclosed with a cover.

* * * * *